US007430966B2

(12) United States Patent
Mabillard et al.

(10) Patent No.: US 7,430,966 B2
(45) Date of Patent: Oct. 7, 2008

(54) BRAKE, VEHICLE AND ROLLER COASTER CIRCUIT

(75) Inventors: Claude Mabillard, Choëx (CH); Walter Bolliger, Antagnes (CH)

(73) Assignee: Bolliger & Mabillard Ingenieurs Conseils S.A., Monthey (CH)

( * ) Notice: Subject to any disclaimer, the term of this patent is extended or adjusted under 35 U.S.C. 154(b) by 419 days.

(21) Appl. No.: 11/093,937

(22) Filed: Mar. 30, 2005

(65) Prior Publication Data

US 2005/0211511 A1 Sep. 29, 2005

Related U.S. Application Data

(63) Continuation-in-part of application No. 10/963,022, filed on Oct. 12, 2004, now Pat. No. 7,377,369.

(30) Foreign Application Priority Data

Oct. 14, 2003 (CH) ..... 1752/03
Dec. 28, 2004 (EP) ..... 04405805

(51) Int. Cl.
*A63G 21/00* (2006.01)

(52) U.S. Cl. ..... 104/72; 104/53; 104/63; 104/83; 104/249; 104/250

(58) Field of Classification Search ..... 104/23.1, 104/23.2, 59, 70, 72, 73; 114/360, 170, 152, 114/153, 355, 361, 357, 288, 271, 274, 280, 114/281, 278, 283; 441/65, 68, 71; 440/39, 440/40, 42, 43

See application file for complete search history.

(56) References Cited

U.S. PATENT DOCUMENTS

| | | | | |
|---|---|---|---|---|
| 2,950,701 | A * | 8/1960 | De Stefani | 440/52 |
| 3,085,537 | A * | 4/1963 | Headrick et al. | 114/278 |
| 3,167,024 | A | 1/1965 | Bacon et al. | |
| 3,685,068 | A * | 8/1972 | Reed | 441/71 |
| 5,613,443 | A | 3/1997 | Ariga et al. | |

FOREIGN PATENT DOCUMENTS

| | | | |
|---|---|---|---|
| CH | 689857 | A5 | 12/1999 |
| DE | 10160039 | C1 | 9/2003 |

* cited by examiner

*Primary Examiner*—Mark T Le
(74) *Attorney, Agent, or Firm*—Clifford W. Browning; Krieg DeVault LLP

(57) ABSTRACT

A roller coaster installation comprising a stretch of water, along which runs a train of vehicles (104) provided laterally with hydrodynamic brakes comprising a fin (102) or a nozzle, becoming immersed in the mass of water (A) and discharging this in the form of rising sprays (B).

25 Claims, 10 Drawing Sheets

FIG.7A
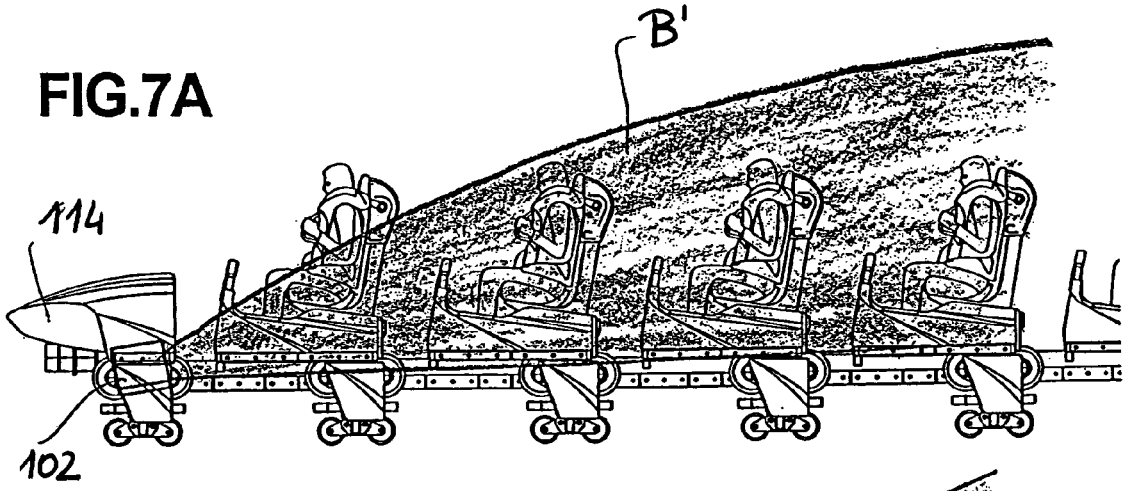
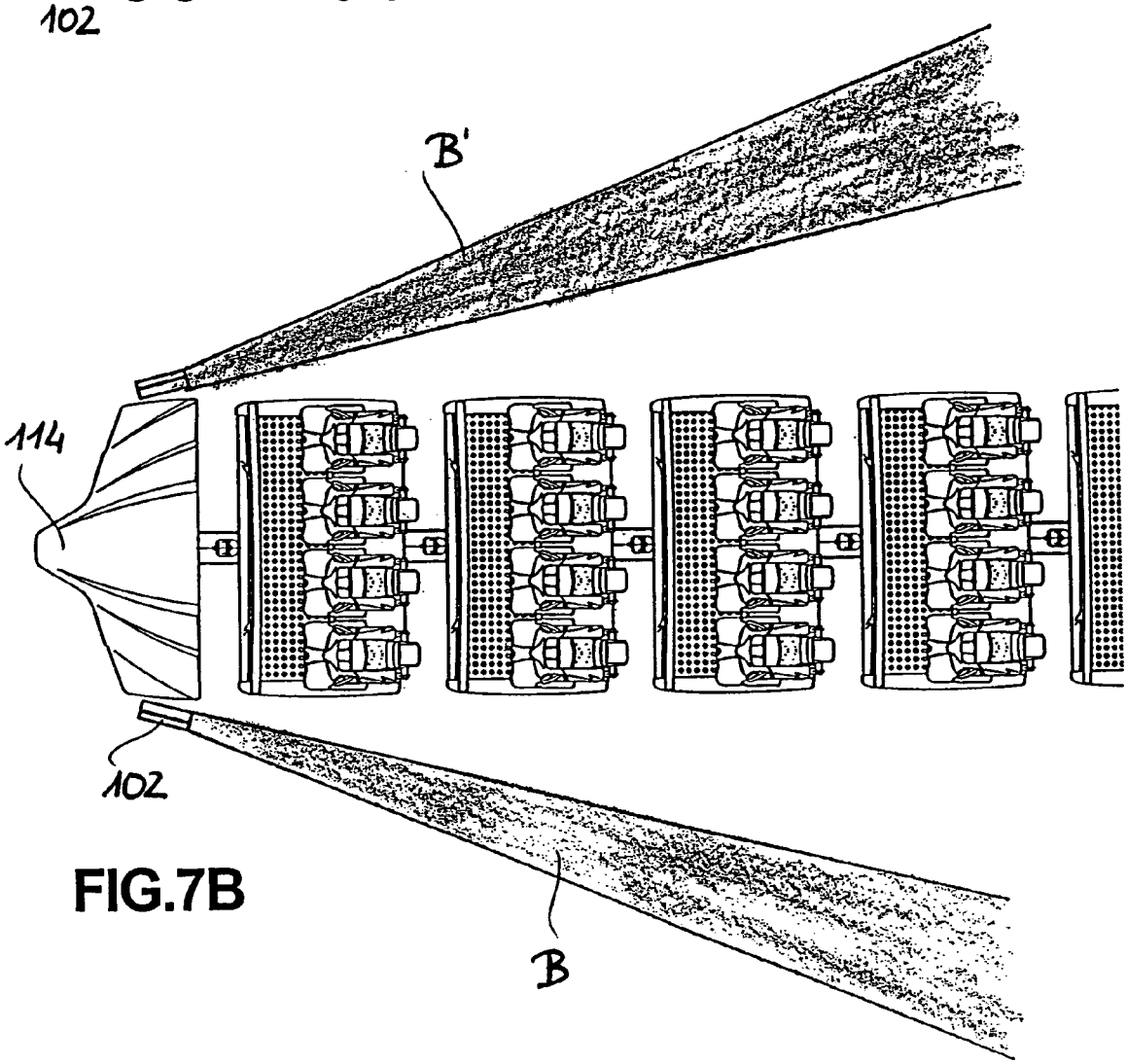
FIG.7B

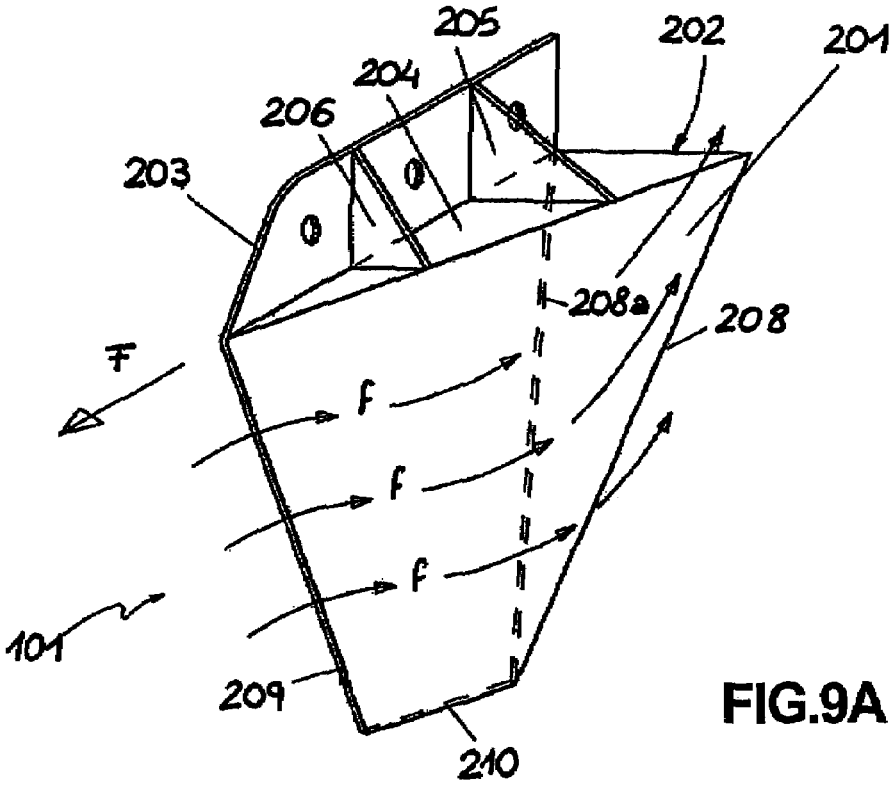
FIG.9A
FIG.9B
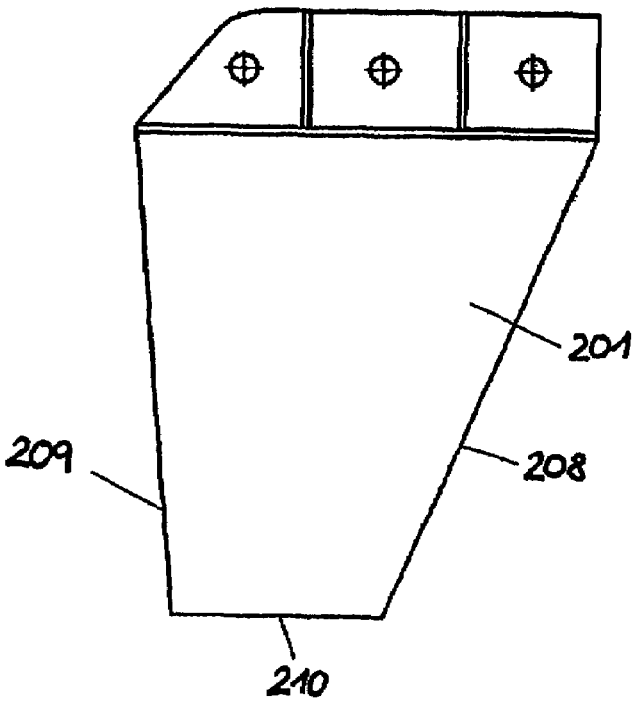
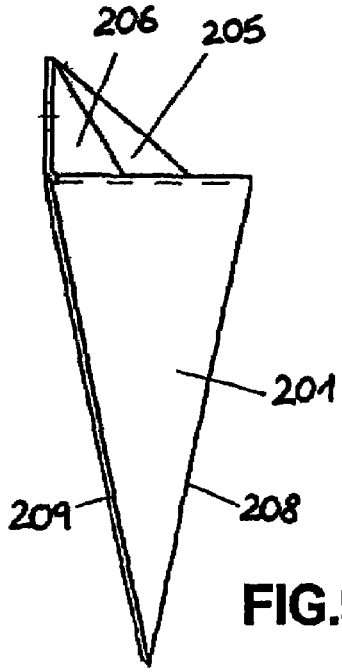
FIG.9C

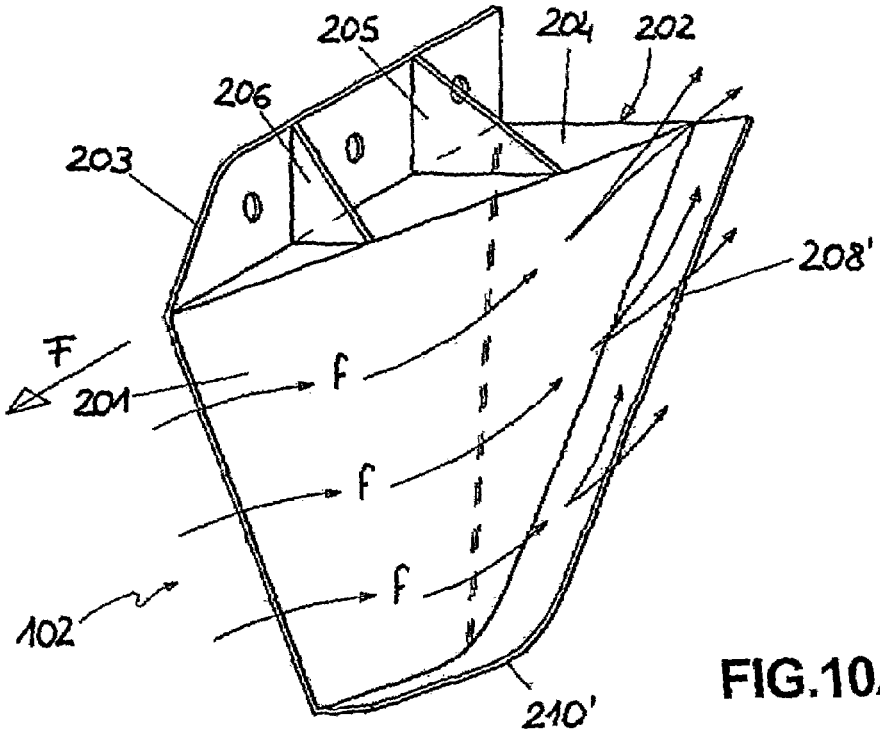
FIG.10A
FIG.10B
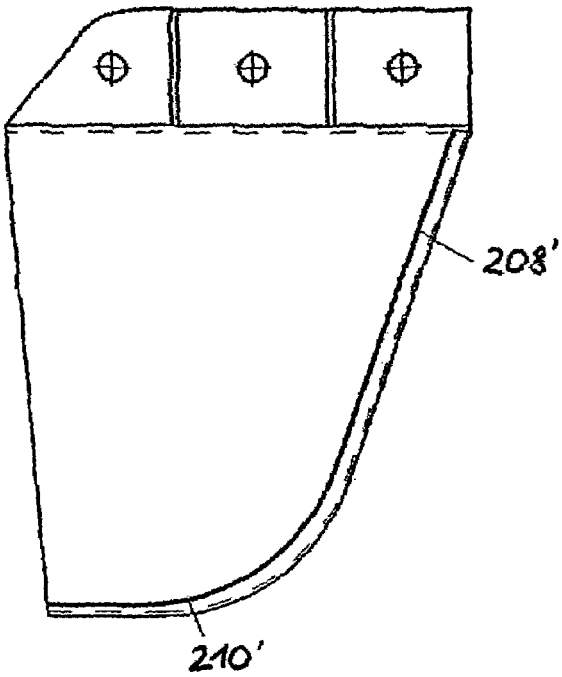
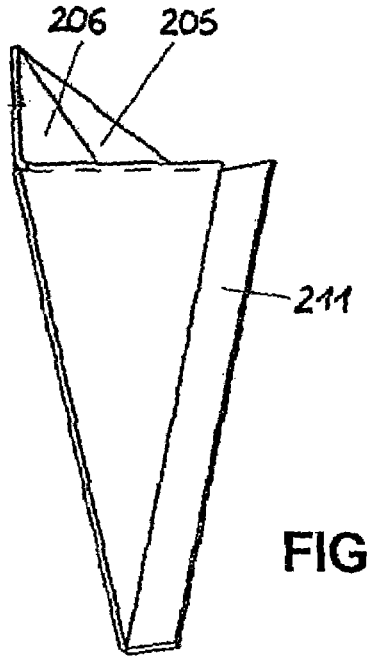
FIG.10C

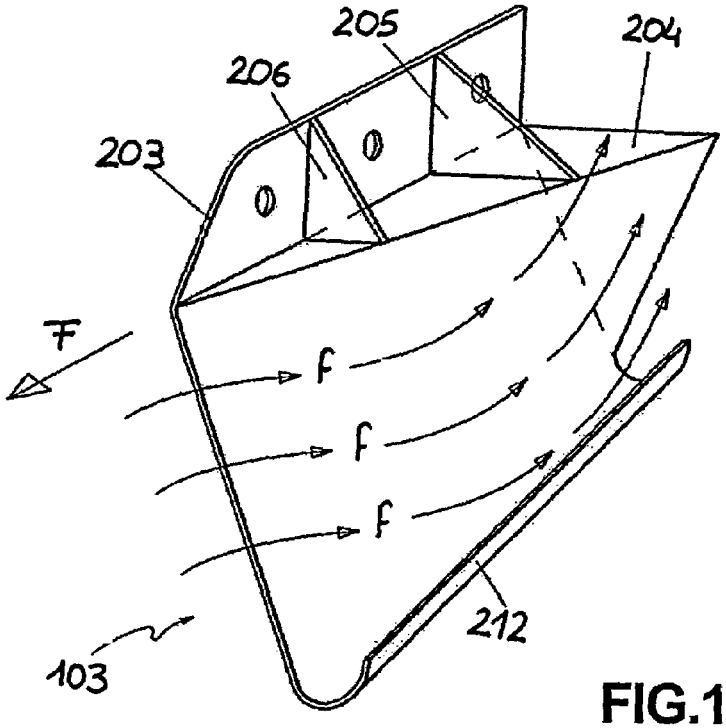
FIG.11A
FIG.11B
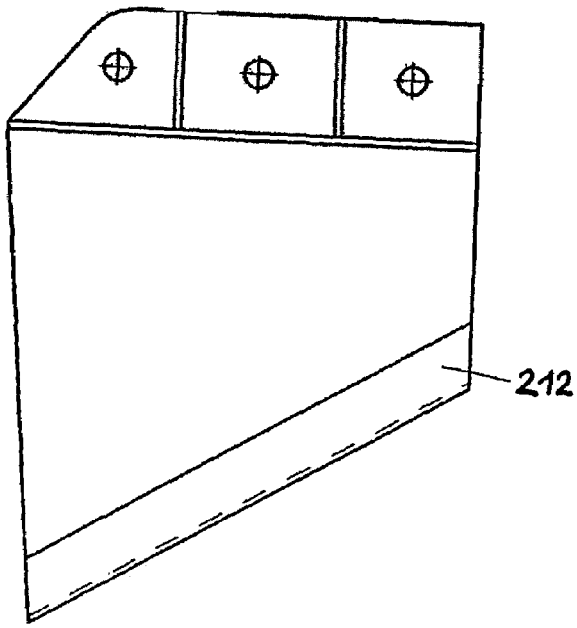
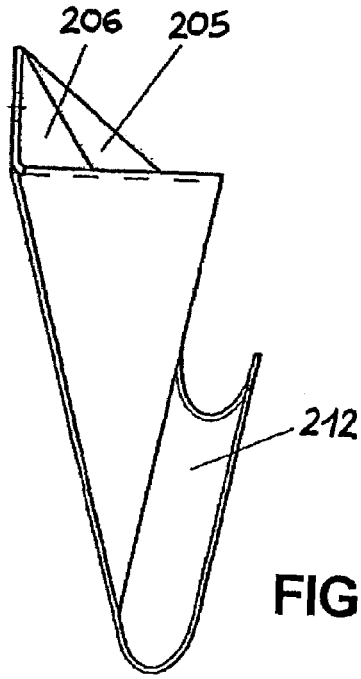
FIG.11C

BRAKE, VEHICLE AND ROLLER COASTER CIRCUIT

This is a continuation-in-part (CIP) of prior application Ser. No. 10/963,022 (U.S. Pat. No. 7,377,369) filed Oct. 12, 2004. Applicants claim foreign priority benefits under 35 U.S.C. 119(a)-(d) or (f), or 365(b) of the following foreign applications for patent: Swiss Application No. 01752/03, filed Oct. 14, 2003 and European Application No. 04405805.5, filed Dec. 28, 2004.

FIELD OF THE INVENTION

The present invention concerns a brake of a roller coaster circuit vehicle, a vehicle equipped with such a brake and a roller coaster installation comprising such a vehicle.

BACKGROUND OF THE INVENTION

Amusement parks are experiencing an ever-increasing success in both the United States, where they originated, and the rest of the world. One of the most spectacular and most impressive attractions is that known by the name "roller coaster". These roller coasters comprise one or more vehicles constituting a train, running on a guide track, generally the rails of a circuit, with steeply sloping portions of circuit. The passengers have a liking for this attraction for the strong impressions it gives. These impressions result to a great extent from the various sensations of acceleration given by the route; they also result from subjective impressions, namely feelings of vertigo, fear, illusion of the risk or surprise faced with the appearance of unexpected events, which the constructor tries to generate through the arrangement of the circuit.

The U.S. Pat. No. 3,167,024 describes a roller coaster installation simulating a bobsleigh run, comprising a pool of water towards the end of the circuit, before the entry to the station. The rails cross the pool, under the surface of the water. The streamlined lower part of the vehicles enters the water during the crossing of the pool, which brakes them whilst raising a spray of water. This installation has several drawbacks: at the moment of the entry of the vehicle into the water, a shock is almost inevitable; at this moment and during the crossing of the pool, the resistance of the water exerts a force which has a large vertical component on the vehicle, which tends to separate the latter from the rails and which must be compensated for by the components of the undercarriage. The mechanical stresses to which the undercarriage is subjected are therefore particularly great with this system. The contact with the water tends to remove lubricating material from the bearings. The repeated shocks, as well as the corrosion due to frequent passing between water and air, tends to cause rapid wear of the undercarriage. In addition, at the slightest sealing defect of the body, the passengers in the vehicle risk being soaked.

The patent CH 689857 of the applicant and the application DE 10160039 describe circuits which pass into a stretch of water, arranged so as to give the passengers an impression of splash-down. The level of the railway line in the stretch of water is below the water level. On account of the vehicles being designed to remain fixed to the rails, these vehicles are then partially submerged in the water, which causes on the one hand considerable braking and on the other hand large sprays of water. This section is followed by a small ramp in order to bring the train of vehicles to the level of the station. These circuits also pose the problems related to a specific design of vehicle having to withstand a very large number of entries in contact with the water in the pool.

SUMMARY OF THE INVENTION

One aim of the invention is to propose a roller coaster installation in which the vehicles can benefit from the braking effect of a body of water, whilst avoiding the above-mentioned mechanical stresses on the equipment.

Another aim of the invention is to be able to generate sprays of water of varied shapes on a section of a circuit in order to benefit from the aesthetic effect and the psychological effect of surprise they cause in the passengers, whilst being in a position to adjust them in terms of height and/or intensity, in such a way that the passengers are not wet, or on the contrary are touched by drops of water if this desired for their amusement.

Another aim of the invention is to obtain a braking effect and these sprays of water without having to use vehicles with enclosing sealed shells, whereas the trend in roller coaster construction is rather to vehicles open on all sides, which increase the sensations of the passengers.

These aims are achieved in a roller coaster installation provided with a stretch of water by virtue of the use of a hydrodynamic brake comprising a deflector means and spacing and fixing means for fixing the deflector means to the vehicle, the said deflector means being arranged so as to enter the water in the stretch of water when the vehicle passes through the corresponding guide-track portion and to raise a water spray.

These aims are achieved in a preferred embodiment of the invention by a roller coaster vehicle brake comprising a nozzle, curved in such a way that the fluid intake and the fluid ejection are oriented in different directions, and fixing means for fixing the nozzle to the frame of a vehicle. The brake is arranged on the vehicle in such a way that the fluid intake opening of the nozzle is oriented towards the front of the vehicle. The term "front of the vehicle" means here the portion of space situated in front of the vehicle and not the components constituting the forward part of the vehicle.

The roller coaster circuit on which the vehicle runs is provided with a stretch of water arranged in close vicinity to the guide trade in such a way that, when the vehicle crosses it or runs alongside it, the intake opening of the brake nozzle goes into the water but, preferably, neither the rails nor other parts of the vehicle than the parts of the brake are in contact with the water.

When the intake opening of the nozzle enters into the water, a relative motion occurs between the walls of the nozzle and the body of water which is momentarily situated inside. On account of the curvature of the nozzle, a component of this relative motion, in a direction different from that of the path of the vehicle, is imparted to the body of water which is momentarily situated inside the nozzle, through transfer of the kinetic energy of the vehicle to this body of water, thus braking the vehicle. At the output of the nozzle, a spray of water is sent in the direction in which this water is ejected from the nozzle, producing a fine visual effect. Persons skilled in the art will understand that, if the nozzle were straight and oriented parallel to the path of the vehicle, the body of water through which the nozzle passed would be scarcely set in motion.

The forward part of the nozzle, comprising the intake opening, and the rear part of the nozzle, comprising the ejection opening, can consist of one or more sections of pipe. This pipe or these sections of pipe can in particular be cylindrical, regular or irregular conical, or cylindro-conical. The forward part and the rear part are connected to one another by a portion of pipe with a bend in it.

The flow rate of water through the nozzle depends essentially on the cross-section of the intake opening and the speed of the vehicle. The cross-section of the ejection opening can be equal to the cross-section of the intake opening. If the cross-section of the ejection opening is smaller than the cross-section of the intake opening, the water has a higher speed at the output and the spray of water has a greater range. If the cross-section of the ejection opening is larger than the cross-section of the intake opening, the speed of the flow at the output is lower and the jet of water is shorter.

Preferably, the nozzle according to the invention is curved in such a way that the direction of the ejected jet of water deviates from the intake direction by an angle greater than 30°, and more preferably greater than 50°, so that a large amount of kinetic energy is transferred from the vehicle to the water set in motion. With an angle of 90°, the range of the jet of water is a maximum. The curvature may even be more important, so that the direction of the ejected jet is oriented towards the front of the vehicle. The ejected jet may be substantially contained in a vertical plane or in a laterally inclined path, either outwardly, so that the ejected jet diverges apart from the guide track, or inwardly, so that the ejected jet passes above the guide track. The angle at the top of the bend in the nozzle, generating the curvature thereof, is preferably between 30° and 150°, more preferably between 30° and 130°.

The intake opening can be substantially perpendicular to the axis of the forward part of the nozzle; this opening can also be contained in a plane inclined with respect to the axis of the forward part in such a way that the upper edge of the intake opening is situated further forward than the lower edge of this opening.

Such water spray effects are not only aesthetically pleasing but, through mechanical reaction effect, tend to press the vehicle against the rail instead of raising it, as was the case in the devices of the prior art.

According to a further preferred embodiment of the invention, these aims are achieved in a roller coaster installation provided with a stretch of water by virtue of the use of a hydrodynamic brake comprising an empennage and spacing and fixing means for fixing the empennage to the chassis or shell of the vehicle, the said empennage being arranged so as to enter the water in the stretch of water when the vehicle passes through the corresponding guide-track portion and to raise a water spray.

These aims are achieved in particular by a brake for a roller coaster circuit vehicle whose empennage comprises a fin. The fin may be shaped and arranged so as to produce rising sprays of water in the form of liquid curtains, whereas a nozzle produces more concentrated jets.

The roller coaster circuit on which the vehicle travels comprises a stretch of water arranged so that, when the vehicle passes through it or along it, the fin of the brake enters the water, but so that neither the rails nor the other parts of the vehicle are in contact with the water.

The hydrodynamically active part of the brake, the deflector, e.g. fin or nozzle, can be fixed to the frame of the vehicle by means of a set of bars and/or rods which makes it secured thereto, whilst making it possible to adjust the lateral and vertical spacing of the deflector with respect to the undercarriage of the vehicle.

Instead of a set of spacing bars, or in addition to such a set of bars, the means of fixing the deflector means to the frame of the vehicle can comprise a plate or a bodywork component in the form of a wing capable of forming a screen between the passengers in the vehicle and discharges of liquid, when the vehicle is crossing a stretch of water and the deflector comes into operation. The fixing means, in the form of bars and/or plates, can moreover contribute towards rigidifying the structure of the deflector means.

Preferably, the vehicle or the group of vehicles constituting a train carries respectively on the left and right of its running carriage a pair or a plurality of hydrodynamic brakes arranged so as to come on each side of and below the guide track, so that the resulting braking force on the left is substantially equal to the resulting braking force on the right.

The shapes, directions and even the number of water sprays raised simultaneously to the left and right of the vehicle or train of vehicles are not necessarily identical. However, in order to minimise the mechanical rotational or torsional stresses which the vehicle undergoes, it is preferable for the braking forces on the left and right to be substantially balanced during the passage of the vehicle through the portion of the guide track where the hydrodynamic braking occurs.

In order to simplify the mechanical design, the roller coaster circuit vehicle according to the invention can carry one or more pairs of such brakes, arranged laterally and symmetrically with respect to the longitudinal plane of symmetry of the vehicle. The symmetrical arrangement in pairs makes it possible easily to balance the braking forces during the interaction of each deflector with water masses situated on each side of the rails where the vehicle is travelling.

The relevant portion of the guide track can be arranged in suspension above the surface of the water in the stretch of water. This portion of the guide track can also be arranged on a mole dividing the stretch of water or on pillars placed in the stretch of water.

According to a preferred embodiment of the invention, the set of parts constituting the running carriage of the vehicle, the bottom face of the vehicle chassis, the vertical spacing parts and the deflectors constituting the hydrodynamic brakes on each side of a vehicle form an inverted U or V open downwards, which delimits a free space and somehow covers the guide track. With this arrangement, the deflectors of the brakes according to the invention can be immersed in a pool situated below a suspended guide track. With this arrangement, the deflectors can also pass on each side of a mole or pillars carrying the guide track and situated inside a stretch of water, the system of rails in the circuit remaining dry, whilst the deflectors are immersed in the water.

The laterally spaced arrangement of the brake with respect to the frame allows the brake to be brought into operation when the vehicle is running alongside a body of water provided for this purpose along its path. The corresponding roller coaster circuit can comprise a channel, consisting of two parallel separation walls, a stretch of water being arranged either side of the channel. The system of rails of the circuit follows this channel whilst remaining in the dry. The walls of the channel are arranged in such a way that their upper edges fit into the free space mentioned above, during the passage of the vehicle in the channel.

BRIEF DESCRIPTION OF THE DRAWINGS

Other characteristics and advantages of the invention will emerge for persons skilled in the art from the detailed description of preferred embodiments of the invention, referring to the figures of the drawing, in which

FIGS. 10A, 10B and 10C show the same views of a second embodiment of a fin, FIGS. 11A, 11B and 11C show the same views of a third embodiment of a fin.

DETAILED DESCRIPTION OF ILLUSTRATIVE EMBODIMENTS

Figure 1:
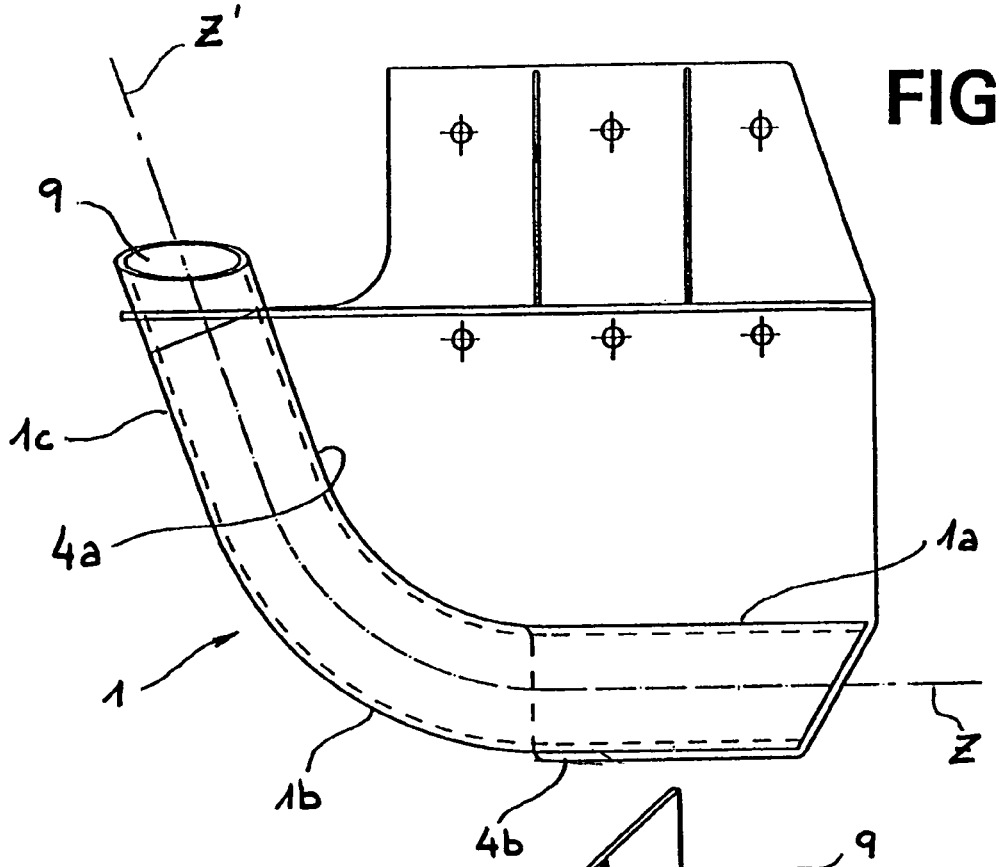
FIG. 1 shows a lateral view in elevation of a brake according to the invention.
Figure 2:
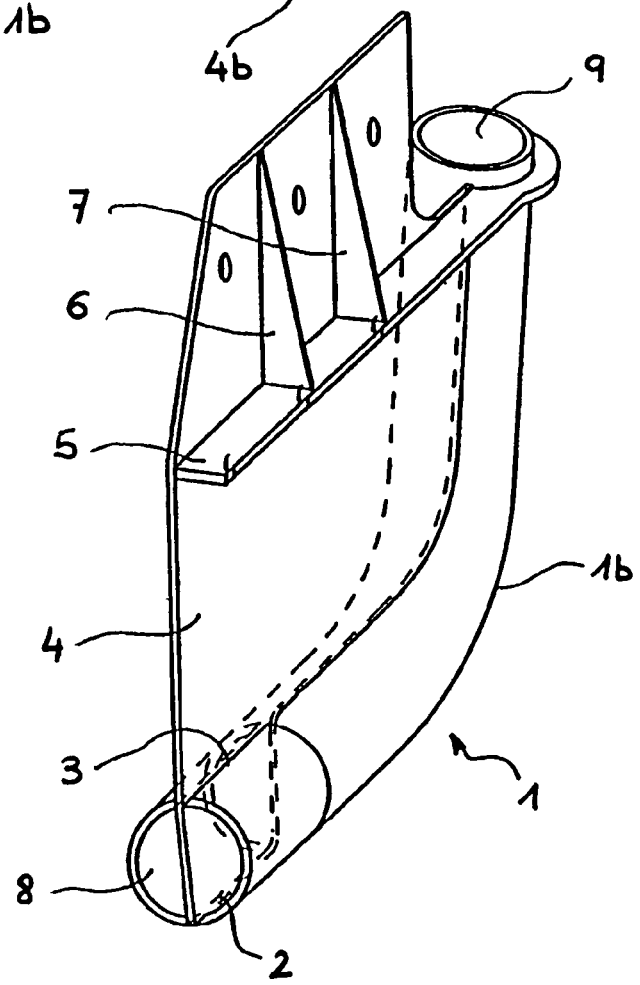
FIG. 2 shows a view in perspective of the same brake.

The nozzle 1 depicted in FIG. 1 and FIG. 2 consists of a pipe of cylindrical section, with a bend in its central part 1*b*. The end of the forward part 1*a*, defining the intake opening 8 of the nozzle, is cut slantwise with respect to the axis Z of this part of the pipe. The end of the rear part 1*c*, defining the fluid ejection opening 9, is also cut slantwise with respect to the axis Z' of this part of the pipe. The forward part 1*a* comprises two longitudinal incisions 2 and 3, diametrically opposite, and contained in the plane defined by the axes Z and Z'. The direction of the axis Z' deviates from the direction of the axis Z by an angle of approximately 70°, so that the angle at the top (Z, Z') is approximately 110°. The planes defining the openings 8 and 9 are perpendicular to the plane defined by Z and Z'.

The nozzle 1 can be fixed to a vehicle by means of a fixing plate 4. The plate 4 is approximately trapezoidal in its upper part and has six holes in it, allowing bolts to be accommodated. One side 4*a* of the lower part of the plate 4 has a rounded outline which fits the internal curve of the pipe constituting the nozzle 1. In the lower extension of the part 4*a*, the plate 4 comprises a protuberance 4*b*, itself trapezoidal in shape, whose dimensions are such that it goes into the slots 2 and 3 in the nozzle 1, going very slightly beyond the lower slot 2 and the opening 8 of the forward part 1*a*.

On one of the sides, the plate 4 comprises a reinforcing bar 5 and two longitudinal members 6 and 7 themselves reinforcing the assembly between the reinforcing bar 5 and the plate 4. One of the ends of the bar 5 comprises a cut-out of elliptical section gripping the rear part 1*c* of the nozzle 1 close to the ejection opening 9. All the components described above are made from steel and are welded to one another, forming a rigid structure.

Figure 4:
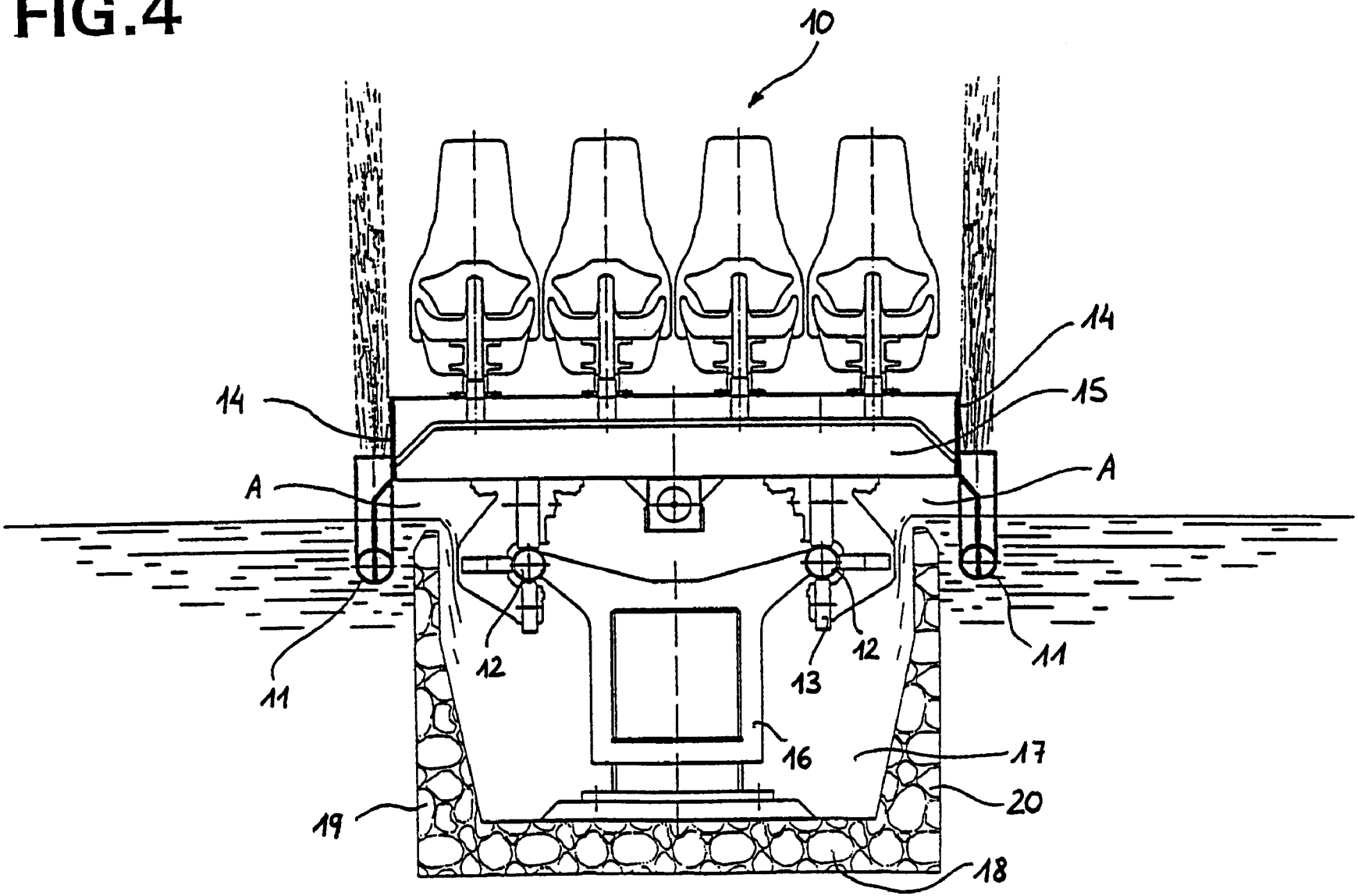
FIG. 4 is a cross-section of a vehicle along the plane XX' of FIG. 3.

FIG. 4 illustrates schematically the mounting of a pair of brakes on the frame of a roller coaster circuit vehicle. In FIG. 4, the fixing plate 14 is not flat as in FIG. 1, but takes the form of a bodywork wing consisting of two flat areas connected by a slantwise discontinuity in alignment. The plates 14 are bolted to each side of the frame 15. The nozzle 11 is similar to the nozzle 1 of FIGS. 1 and 2. FIG. 4 shows schematically the rails 12 and the undercarriage 13 of the vehicle; the structure of such undercarriages 13 is known in other respects and does not form part of the present invention. It should be noted that, between the undercarriage 13, the lower face of the frame 15 and the plates 14, there is formed on each side a free space A which, seen in cross-section, forms overall an inverted U.

The rails 12 are attached to a steel structure 16, itself disposed in a channel 17 formed by a bottom 18 and two walls 19 and 20 made of masonry. The height and thickness of the wall 19, and the shape of the fixing plate 14, are chosen so that, when the vehicle 10 is running on the rails 12, the top of the wall 19 fits inside the space A without touching either the undercarriage 13, the bottom of the frame 15, or the plate 14 or nozzle 11 of the brake. Same arrangement applies to the wall 20.

A stretch of water is arranged either side of the walls 19 and 20, in such a way that the latter delimit between them a dry or almost dry channel 17: water can overflow over the top of the walls 19 and 20 and fill the bottom of the channel, giving from a distance the optical illusion that this is also filled with water. However, the circuit is arranged in such a way that the level of water in the channel 17 always remains distinctly lower than the level of the rails 12 so that, when the vehicle 10 follows this channel 17, the undercarriage 13 does not go into the water.

Figure 3:
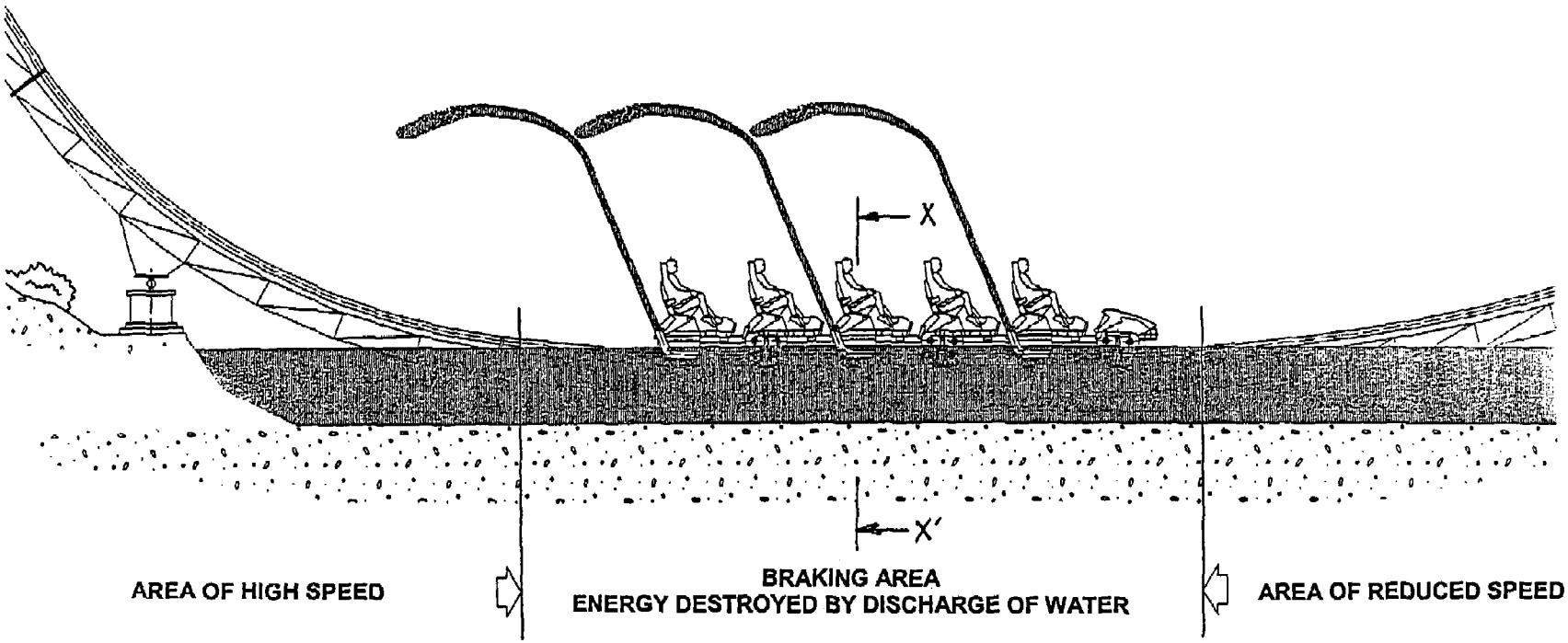
FIG. 3 is a lateral view of a train of vehicles crossing a stretch of water of a circuit.

FIG. 3 depicts schematically in a side view the crossing of the stretch of water by a train of vehicles carrying passengers. In the left-hand area, the vehicle arrives from a steeply sloping part and is endowed with a high speed. The curvature of the rails is such that the forward part of the nozzles goes into the water practically tangentially, that is to say almost parallel to the axis Z. The central part of FIG. 3 shows the braking area, in which the movement of the vehicles generates a motion of the body of water passing through the nozzles. As a result of the curvature of the nozzles, the body of water, initially at rest, undergoes an acceleration upwards and is ejected at high speed, as illustrated in FIG. 3. The vehicle thus loses kinetic energy, used to produce sprays of water which surround it on either side, so that it leaves the channel of the stretch of water at reduced speed.

In FIGS. 3 and 4, the axes of the rear parts of the nozzles are situated in a vertical plane and are slightly inclined towards the rear, so that the sprays of water are situated overall in a vertical plane and directed towards the rear of the vehicle. It has thus been possible to obtain, for example, with a vehicle launched at a speed of 20 m/s, a spray rising to approximately 16-18 m, and falling at a distance of around 40-50 m, the axis of the ejection opening of the nozzle forming an angle of 70° with the horizontal. Persons skilled in the art will understand that, by virtue of other orientations of the rear part of the nozzles, the sprays of water can be oriented in all desired directions. The sprays of water can be directed in particular laterally outwards, on either side, so that the passengers absolutely do not risk being wet. On the contrary, in particular during summer operation of the amusement park, the nozzles can be oriented in such a way that the sprays of water form temporary arches over the train of vehicles.

FIGS. 9A, 9B and 9C show a first embodiment of a hydrodynamic brake fin 101 according to the invention. The fin is formed from an assembly of a trapezoidal plate 201 forming the external flank of the fin, a triangular plate 202 forming the rear face of the fin, and a third plate 203 extended upwards by a portion with three holes in it intended to receive bolts with a view to fixing to the chassis of the vehicle via spacing pieces. The plates 201 and 203 are joined by their edges situated on the left in the figures, forming the leading edge 209 of the fin 101, and by the bottom edges, forming the bottom edge 210 of the fin. The triangular plate 202 joins the other two lateral edges of the plates 201 and 203, forming two trailing edges 208, 208*a*. The plate 201 is therefore not perfectly planar but has a concave external surface. The fin 101 is produced in the form of a box formed by means of a top plate 204, and has two reinforcing pieces 205 and 206, as shown in the figures. The arrow F represents the path of the fin 101 and the arrows f represent the relative movement of a mass of water along the external flank of the fin formed by the plate 201. According to variants, not shown, of this embodiment, the fin 101 can be arranged so that the plate 201 has a planar or convex surface.

FIGS. 10A, 10B and 10C show a second embodiment of a hydrodynamic brake fin 102 according to the invention. This embodiment uses the same structure as that shown in FIGS. 9A, 9B and 9C, whose elements are designated by the same reference numbers. It is supplemented by a deviating plate 211 arranged along the bottom edge and the rear edge of the plate 201. The deviating plate 211 can be made in one piece with the rear plate 202. It strongly diverts the mass of liquid flowing along the plate 201 and constitutes the bottom edge 210' and the trailing edge 208' of the fin.

FIGS. 11A, 11B and 11C show a third embodiment of a hydrodynamic brake fin 103 according to the invention. This fin 103 uses the same basic structure as the first and second embodiments. As shown in FIG. 11B, the bottom edge of the plates 201 and 203 is not parallel to the top edge, but inclined with respect to it. It is extended by a channel 212 arranged as shown in the figures, which can be produced simply by a curved extension of the plate 201 or of the plate 203.

The fins 101, 102 and 103 can be produced by means of welded and/or bent steel plates.

Figure 8:
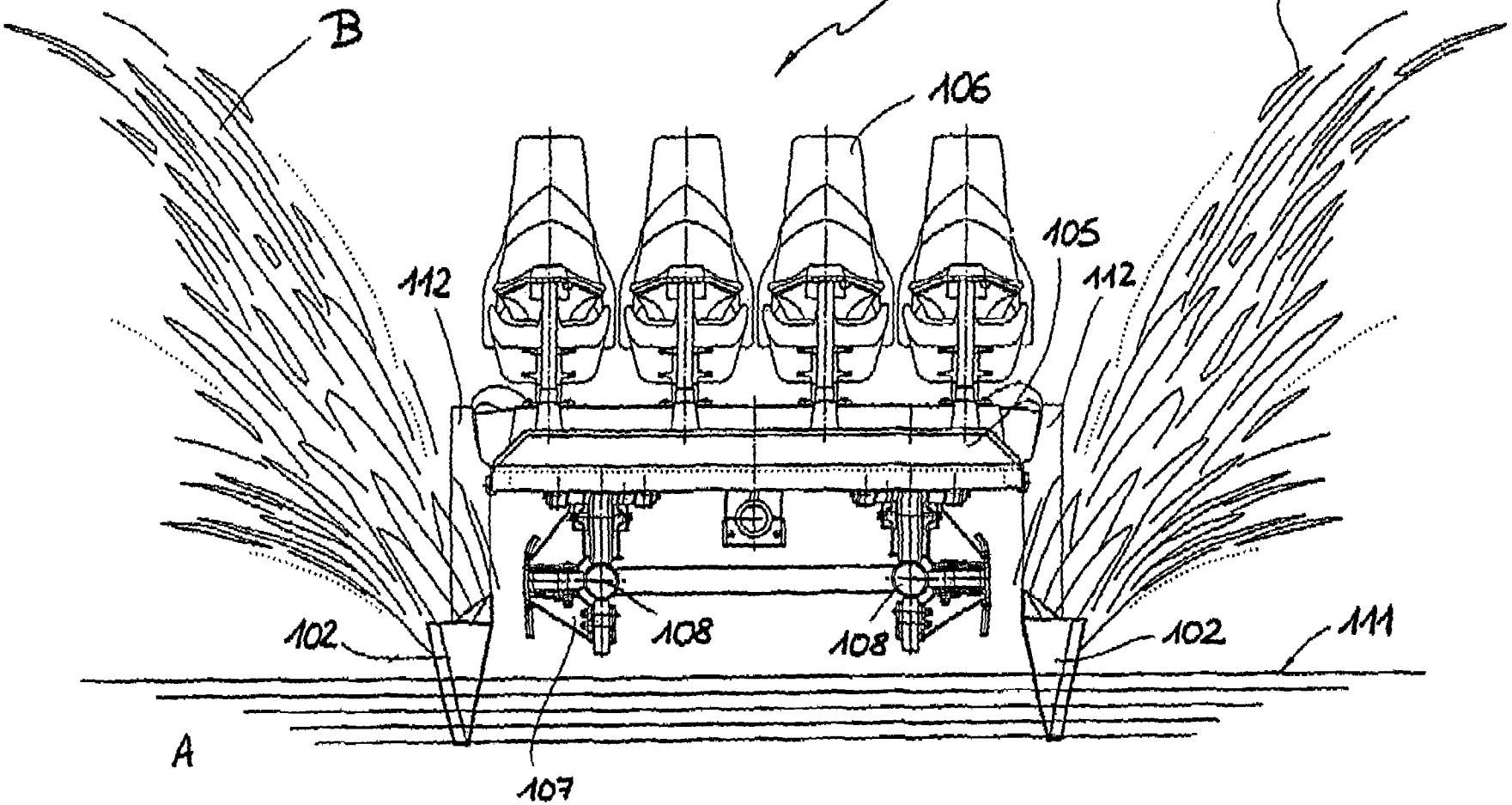
FIG. 8 is a transverse section of a vehicle on a third embodiment of a portion of the guide track, provided with brakes according to FIG. 10A, FIGS. 9A, 9B and 9C show a perspective view, a side view and a front view in elevation of a first embodiment of a brake fin according to the invention.

FIG. 8 shows the arrangement of a portion of an installation with a roller coaster circuit vehicle. The vehicle 104 comprises a chassis 105 forming a platform, on which a row of four seats 106 is mounted. A running carriage 107 is fixed under the chassis. The running carriage cooperates with tubular rails 108 in order to prevent any vertical and lateral play. This type of running carriage on rails is known in the prior art. A portion of the guide track 108 passing through the stretch of water A is shown in suspension above the latter, the level of the water being indicated by 111. The means for mounting a section of a pair of rails in suspension are known per se and do not need to be described here. The chassis 105 carries on each side two fixing plates 112 extending downwards. At the bottom of these fixing plates there is fixed a pair of fins 102 identical to those visible in particular in FIG. 10C. The dimensions of the fixing plates 112 are chosen so that the fins 102 come below the level 111 of the surface of the water over approximately half of their height. The water sprays raised are shown by B, B' in the Figure. Their shape is that of a wall of water parallel to the direction of the axis of the track; the shape in transverse section is similar to that generated by a nautical monoski in a curve.

Figure 5:
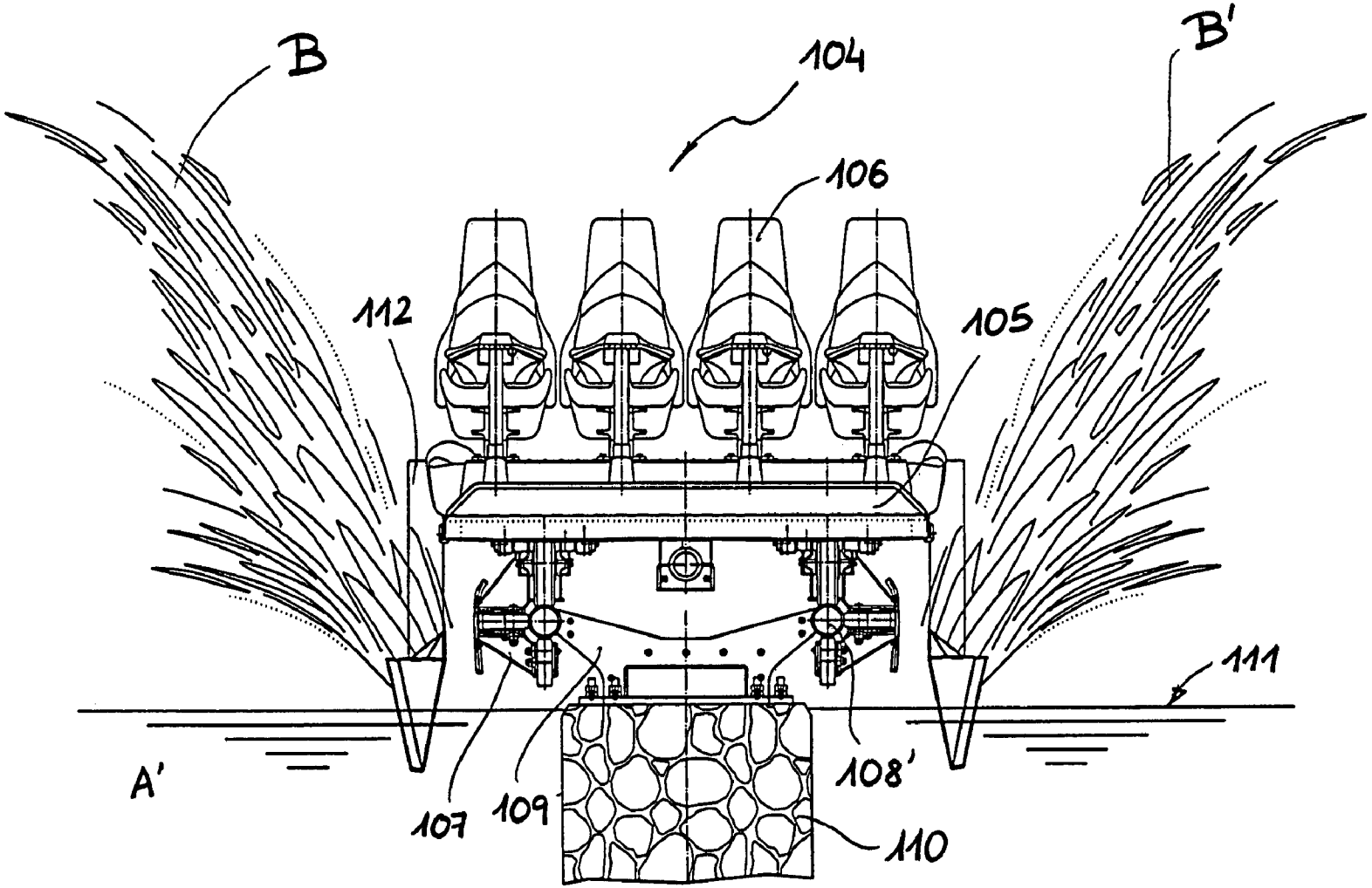
FIG. 5 is a transverse section of a vehicle on a second embodiment of the guide track, provided with brakes according to FIG. 10A, FIGS. 6A and 6B are respectively side and plan views of a vehicle train provided with a pair of brakes according to FIG. 11A, FIGS. 7A and 7B are views respectively side and plan of a train of vehicles provided with a pair of brakes according to FIG. 10A.

FIG. 5 shows another embodiment of the installation, in which the rails 108' are carried by a series of cross members 109, themselves mounted on a mole or on pillars 110 through means known per se. As shown by FIG. 5, the mole or the pillar situated in the stretch of water A' can be produced from masonry or prefabricated blocks. For the rest, the embodiment shown by FIG. 5 is identical to that shown by FIG. 8. The spacing plates 112 are sufficiently long for the fins 102 to be immersed in the water, and they protect the passengers from splashes.

Figure 6A:
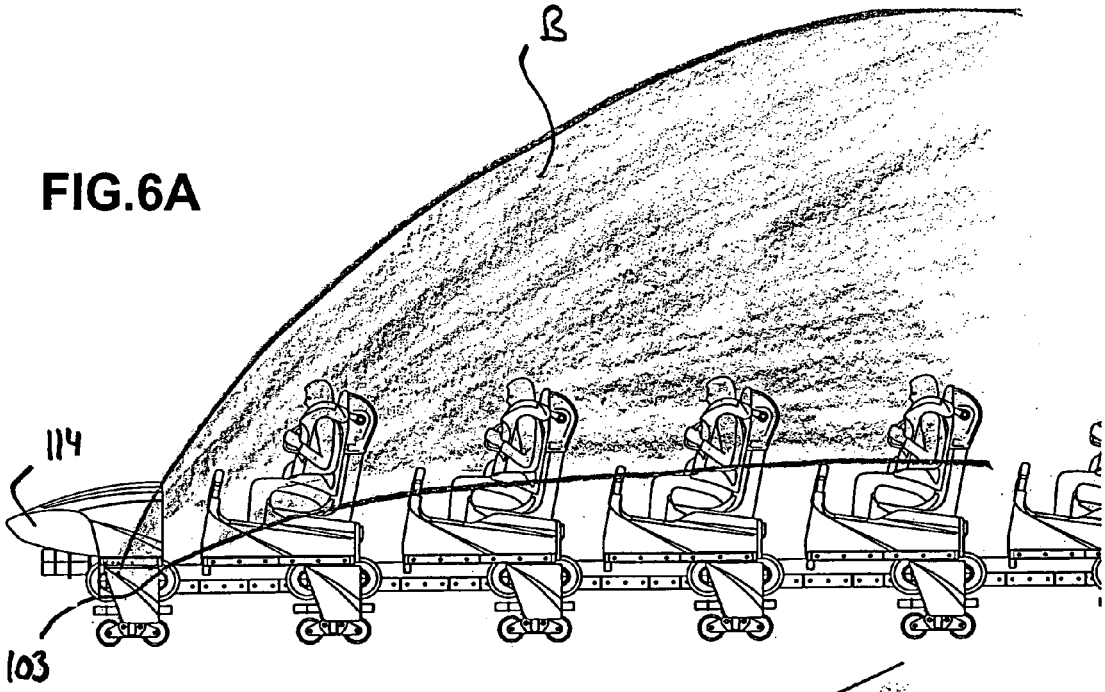
Figure 6B:
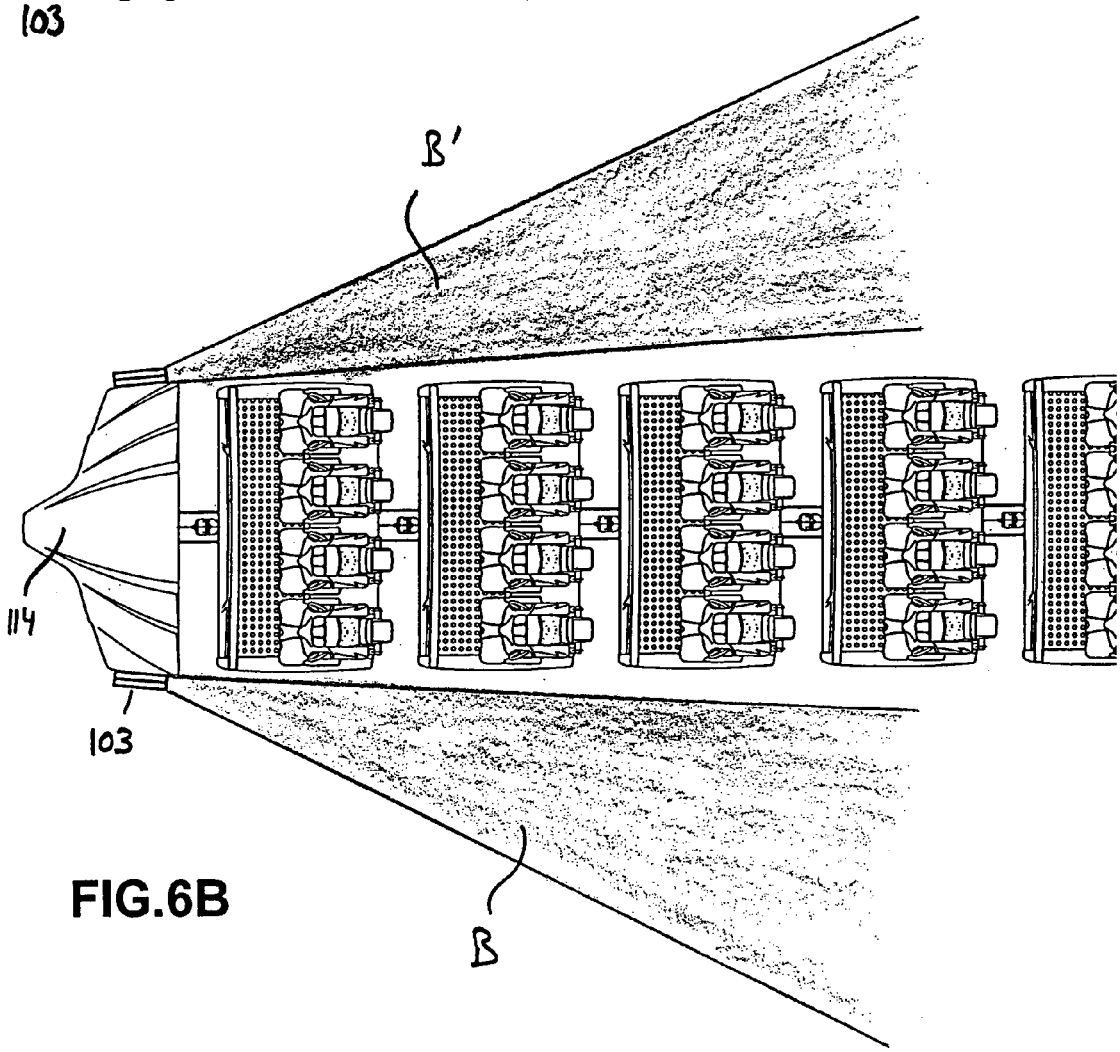

FIGS. 6A and 6B show a train of vehicles 113 whose front fairing 114 carries a pair of brakes provided with fins 103 of the type shown by FIGS. 11A, 11B and 11C. The two fins 103 are mounted so that their channels converge slightly towards the front. The result is a pair of sprays divergent towards the rear, in the form of water blades.

Likewise, FIGS. 7A and 7B show a train of vehicles 113' whose front fairing 114' carries a pair of brakes provided with fins 102 of the type shown by FIGS. 10A, 10B and 10C.

A person skilled in the art is in a position to obtain extremely variable water spray effects by varying the shapes and arrangement of the brakes according to the invention, in particular the conformation of the deflectors examples of which have been described above, without departing from the scope of the invention defined by the claims. In particular, one may associate on a same vehicle train different pairs of brakes, for example a pair of nozzle-brakes with ejection openings oriented forwards together with a pair of nozzle-brakes having ejection openings oriented backwards; or a pair of fin-brakes and a pair of nozzle-brakes; and many other esthetical arrangements.

What is claimed is:

1. A roller coaster installation comprising a guide track comprising rails, at least one vehicle guided on said rails, the vehicle comprising a frame and an undercarriage for guiding the vehicle on the rails, the roller coaster installation further comprising at least one stretch of water arranged under or alongside a portion of the guide track, the said vehicle being provided with at least one hydrodynamic brake, wherein said hydrodynamic brake comprises deflector means and spacing and fixing means for fixing said deflector means to the vehicle, said deflector means comprising a fin being arranged so as to penetrate water in the said stretch of water when the vehicle passes through the said portion of the guide track and so as to raise a water spray, and wherein said stretch of water and said guide track are arranged in a way that the rails and the vehicle, including the frame and the undercarriage, remain out of the water when the vehicle passes through said portion of the guide track.

2. An installation according to claim 1, wherein the guide track, the vehicle and the stretch of water are arranged so that the hydrodynamic brake is the only part of the vehicle to enter the water.

3. An installation according to claim 1, wherein said portion of the guide track is arranged in suspension above the surface of the water in the stretch of water.

4. An installation according to claim 1, wherein said portion of the guide track is arranged on a mole or pillars placed in the stretch of water.

5. An installation according to claim 1, wherein said stretch of water comprises a channel, delimited by two parallel separation walls, wherein said portion of the guide track follows said channel, and wherein the level of water in said channel is sufficiently low for the undercarriage of the vehicle to not touch the water.

6. An installation according to claim 1, wherein said portion of the guide track is arranged at the end of travel of the vehicle, before entering an arrival station of the installation.

7. An installation according to claim 1, wherein said fin comprises a strut forming an internal flank of the said fin and extending upwards to permit the fixing of the fin to a chassis or shell of the vehicle.

8. An installation according to claim 1, wherein said fin has in horizontal section approximately in the form of a triangle, a vertex of which constitutes a leading edge of the fin.

9. An installation according to claim 1, wherein said fin has, in cross section along a plane perpendicular to an axis of the guide track, approximately the form of a triangle, a vertex of which forms a bottom edge of the fin.

10. An installation according to claim 1, wherein a bottom edge and/or a trailing edge of the fin carry a deviating plate.

11. An installation according to claim 1, wherein a bottom edge and/or a trailing edge of the fin carry a deviating plate having the form of a channel.

12. An installation according to claim 1, wherein said deflector means comprise a nozzle curved in such a way that a fluid intake and a fluid ejection are oriented in different directions.

13. An installation according to claim 12, wherein a forward part of the nozzle comprising the intake and a rear part of the nozzle comprising the ejection consist of one or more pipes and are connected to one another by a portion of pipe with a bend in it.

14. An installation according to claim 13, wherein said pipes are selected from the group consisting of cylindrical, regular or irregular conical, and cylindro-conical pipes.

15. An installation according to claim 12, wherein the ejection direction deviates from the intake direction by an angle greater than 30°.

16. An installation according to claim 13, wherein an angle at the top of the bend is between 30° and 130° C.

17. An installation according to claim 12, wherein means of fixing the nozzle to the frame of the vehicle comprise a set of bars making it possible to adjust a spacing of the nozzle with respect to the undercarriage of the vehicle.

18. An installation according to claim 12, wherein means of fixing the nozzle to the frame of the vehicle comprise a bodywork component in the form of a wing capable of forming a screen between passengers in the vehicle and discharges of liquid.

19. An installation according to claim 12, wherein fixing means comprise one or more fixing plates, arranged so as to rigidify the structure of the nozzle.

20. An installation according to claim 1, wherein the fin is the only part of the vehicle that penetrates into water when the vehicle passes through the said portion of track.

21. An installation according to claim 1, the at least one vehicle comprising a chassis forming a platform carrying seats for passengers, and wherein the undercarriage is fixed below the chassis.

22. An installation according to claim 1, wherein said stretch of water, said undercarriage and said guide track are arranged so that the guide track stays outside the water when the vehicle passes through said portion of the guide track.

23. An installation according to claim 1, wherein said vehicle is arranged on the guide track so that the guide track is present below seats for passengers.

24. An installation according to claim 1, wherein parts of the vehicle other than the at least one hydrodynamic brake pass besides or above said stretch of water when the vehicle passes through said portion of the guide track.

25. An installation according to claim 1, wherein at least one separation wall delimits said stretch of water from said portion of the guide track.

* * * * *